US009651234B2

(12) United States Patent
Zagoras

(10) Patent No.: US 9,651,234 B2
(45) Date of Patent: May 16, 2017

(54) UNDERWATER LIGHT (LED) OF FIXED TILT ANGLE 0°-80° DEGREES FOR MULTIPLE APPLICATIONS WITH OPTIONAL GYRO SENSOR

(71) Applicant: Ioannis-Petros Zagoras, P. Iraklio Attikis (GR)

(72) Inventor: Ioannis-Petros Zagoras, P. Iraklio Attikis (GR)

( * ) Notice: Subject to any disclaimer, the term of this patent is extended or adjusted under 35 U.S.C. 154(b) by 160 days.

(21) Appl. No.: 14/762,365

(22) PCT Filed: Feb. 19, 2014

(86) PCT No.: PCT/GR2014/000011
§ 371 (c)(1),
(2) Date: Jul. 21, 2015

(87) PCT Pub. No.: WO2014/128514
PCT Pub. Date: Aug. 28, 2014

(65) Prior Publication Data

US 2015/0354800 A1 Dec. 10, 2015

(30) Foreign Application Priority Data

Feb. 25, 2013 (GR) ..... 20130100104

(51) Int. Cl.
*F21V 23/04* (2006.01)
*F21V 29/70* (2015.01)
(Continued)

(52) U.S. Cl.
CPC ..... *F21V 23/0492* (2013.01); *F21V 15/01* (2013.01); *F21V 29/70* (2015.01);
(Continued)

(58) Field of Classification Search
CPC ..... F21V 23/0492; F21V 29/70; F21V 29/71; F21V 29/89; F21V 15/01; F21V 31/00;
(Continued)

(56) References Cited

U.S. PATENT DOCUMENTS 2,593,171 A * 4/1952 Morse ..... B63B 45/02 362/477
3,803,400 A * 4/1974 Ozawa ..... B60Q 3/0286 362/372
(Continued)

FOREIGN PATENT DOCUMENTS

DE 202 20 900 U1 7/2004
DE 20 2006 008290 U1 10/2006
(Continued)

OTHER PUBLICATIONS

International search report in PCT/GR2014/000011 mailed Jul. 4, 2014.
Written Opinion in PCT/GR2014/000011 mailed Jul. 4, 2014.

*Primary Examiner* — Bryon T Gyllstrom
(74) *Attorney, Agent, or Firm* — Oppedahl Patent Law Firm LLC

(57) ABSTRACT

The Underwater Light (LED) of Fixed Tilt Angle 0°-80° degrees for multiple applications with elective Gyro Sensor, which comprises of the fixed Inclined Outer Body (1, 2) with cylindrical internal configuration, the cylindrically shaped Solid Thermally Conductive Inner Core (Head) (3), the Peripheral Metal Coating Layers (4, 5) with embedded Scaled Thermal Conductivity λ of symmetric or non symmetric metal coating thickness of the cylindrically shaped Solid Thermally Conductive Inner Core (Head) (3), due to the fixed inclination 0-80° degrees (17) of the Inclined Outer Body with cylindrical internal configuration, the light beam angle is not affected by vibrations, oscillations or shocks, while at the same time it solves existing problems during
(Continued)

night departure bow or stern mooring process, such as the process of approaching to shallow for floating means waters and of course it constitutes a principal or auxiliary safety system in case of overturning thereof. It can contribute to any sea research, tracking and rescue operations, because of the inclined form the outer body but also thanks to the construction properties of the whole unit. It extinguishes navigation nuisance problems caused ordinary fishing lamps, occupying a small volume. The use of the invention relates to floating means (eg speedboats, cruising boats etc.) organized marinas, decorative architectural underwater lighting such as swimming pools, decorative waterfalls, fountains etc where based on the inherent manufacturing advantages thereof it contributes to energy saving, offered by (LED) technology against corresponding energy intensive lighting systems.

8 Claims, 4 Drawing Sheets

(51) Int. Cl.

| | |
|---|---|
| ***F21V 31/00*** | (2006.01) |
| ***F21V 31/04*** | (2006.01) |
| ***F21V 15/01*** | (2006.01) |
| ***F21V 29/71*** | (2015.01) |
| ***F21V 29/89*** | (2015.01) |
| *F21K 9/00* | (2016.01) |
| *F21W 101/04* | (2006.01) |
| *F21W 131/401* | (2006.01) |
| *F21Y 115/10* | (2016.01) |

(52) U.S. Cl.
CPC ..... *F21V 29/71* (2015.01); *F21V 29/89* (2015.01); *F21V 31/00* (2013.01); *F21V 31/04* (2013.01); *F21K 9/00* (2013.01); *F21W 2101/04* (2013.01); *F21W 2131/401* (2013.01); *F21Y 2115/10* (2016.08)

(58) Field of Classification Search
CPC ..... F21V 31/04; F21Y 2115/10; F21K 9/00; F21W 2101/04; F21W 2131/401
USPC ..... 362/276
See application file for complete search history.

(56) References Cited

U.S. PATENT DOCUMENTS

| | | | | | |
|---|---|---|---|---|---|
| 4,429,350 | A * | 1/1984 | Guthrie | F21L 14/00 | 362/109 |
| 5,585,783 | A * | 12/1996 | Hall | B60Q 7/00 | 340/473 |
| 6,315,429 | B1 * | 11/2001 | Grandolfo | A01K 63/06 | 362/158 |
| 8,033,677 | B1 * | 10/2011 | Olsson | F21V 7/0083 | 114/312 |
| 8,123,372 | B1 * | 2/2012 | Ball | F21S 8/00 | 362/101 |
| 2002/0125804 | A1 * | 9/2002 | McGuire | F21L 4/00 | 313/112 |
| 2006/0002104 | A1 * | 1/2006 | Willis | F21V 23/005 | 362/101 |
| 2008/0165547 | A1 * | 7/2008 | Amor | B63B 45/02 | 362/373 |
| 2014/0268824 | A1 * | 9/2014 | Potucek | F21V 21/047 | 362/366 |

FOREIGN PATENT DOCUMENTS

| | | |
|---|---|---|
| EP | 1 139 439 A1 | 10/2001 |
| FR | 1 017 282 A | 12/1952 |
| WO | WO 2006/094346 A1 | 9/2006 |
| WO | WO 2010/083047 A1 | 7/2010 |

* cited by examiner

UNDERWATER LIGHT (LED) OF FIXED TILT ANGLE 0°-80° DEGREES FOR MULTIPLE APPLICATIONS WITH OPTIONAL GYRO SENSOR

The invention relates to Underwater Light (LED) of Fixed Tilt Angle 0°-80° degrees for multiple applications with elective Gyro Sensor comprising of: a fixed Inclined Outer Body with cylindrical internal configuration, under angle 0°-80° degrees, a cylindrically shaped Solid Thermally Conductive Inner Core (Head), the Peripheral Metal Layer Coatings with embedded Scaled Thermal Conductivity λ of symmetric or non symmetric coating thickness of the cylindrically shaped Solid Thermally Conductive Inner Core (Head), the LED Light Emitting Diode, the optional Gyro Sensor, the Beam Reflector, the External Lens or Diffuser, the Thermostat, the Nitrogen (N2) Charging Port, the Auxiliary Heatsink, the Rubber Gasket, the Cabling Channel, the Pressure Relief Port, the Sealing Bolt and the Front Mounting Ring.

Similar autonomous Underwater Lighting systems are bulky in order to achieve satisfactory heat dissipation and of course the mounting surface thereof, on a boat's stern for example, is approximately perpendicular towards the cruising course axis, as for example on the "transom" of speedboats. Therefore, the emitted light beam is restricted only backwards aligned with the boat's cruising axis. In addition to other use of applications such as swimming pools, decorative jet (fountains), architectural lighting or decorative waterfalls, the existing structures, in order to achieve the desired light beam emission angle, regardless of their placement, have a supplementary support extension mounted in the transverse axis (with screws). The way of such a mounting makes the whole fixture vulnerable to any external stressing (e.g. vibrations, shocks, oscillations etc.) with consequences to frequent adjustments.

The main characteristics of the invention are the cylindrically shaped Solid Thermally Conductive Inner Core (Head), on which the LED Light Emitting Diode is mounted, the Peripheral Metal Coating with embedded Scaled Thermal Conductivity λ Layers of symmetric or non symmetric metal coating thickness of the cylindrically shaped Solid Thermally Conductive Inner Core (Head), the embedded configuration for both the passage of power supply cabling and for the Nitrogen (N2) Charging as well, the optional Gyro Sensor and finally the Thermostat, for the system's overheating protection.

Some of the inherent advantages of Underwater Light (LED) of Fixed Tilt Angle 0°-80° degrees for Multiple Applications with optional Gyro Sensor and the solutions to existing problems of similar lights are described below:

- Coverage of extremely small volume in relation to the luminous intensity output of the lamp mainly due to the construction of the cylindrically shaped Solid Thermally Conductive Inner Core (Head) as well as of the way of dissipation of the emitted heat through the arrangement of Peripheral Metal Coating with embedded Scaled Thermal Conductivity Layers of symmetric or non symmetric coating thickness during the operation of the LED Light Emitting Diode.
- Consumption problems of conventional incandescent lamps are eliminated since the embedded LED Light Emitting Diode both structurally and from the construction point of view derives from the implementation of modern energy saving technology and therefore is characterized as environmentally friendly.

- The invention eliminates the usual problems of maintaining light emission angle as it does not consist of moving parts and therefore it can be used both on floating means (i.e. speedboats, cruising boats etc.) and in organized marinas, swimming pools, architectural decorative lighting, decorative waterfalls, jet fountains and other applications.
- It mainly or subsidiarily contributes to the security of floating means, since, through the built-in optional Gyro Sensor, in case of a tip over, for example, of a speedboat, the light emission of intermittent flashing distress signal is activated (pursuant to the International Morse Code), which in this case recovers upward direction of the light beam. Therefore the light beam is visible from far away.
- It eliminates problems of efficiency in any maritime operations for search, tracking and rescue, since because on the one hand of the inclined form of the Outer Body and due, on the other, to the inherent structural properties, the installation of the unit is carried out underwater, ahead the operator, and consequently facilitation in any inspection becomes effective.
- It eliminates existing problems and contributes essentially during the safe arrival of floating means, especially during the bow or stern-mooring process, as it widens the field of vision downwards to the shallow waters rather than horizontally.
- The Underwater Light (LED) of Fixed tilt angle 0°-80° for multiple applications with optional Gyro Sensor, when used as fishing aid device is obligatorily installed below the sea surface and therefore it eliminates the problem of harassment of navigation created by the conventional energy-intensive lights (lantern incandescent or gas lamps), as the controlled light beam is emitted downwards only.
- Due to the indirect lighting it prevents potential problems of photobiological impact because of exposure to direct high power LED lights, as for example to spectators watching night speedboat shows.

The invention is described in details below with reference to the attached drawings or figures in which.

Figure 1:
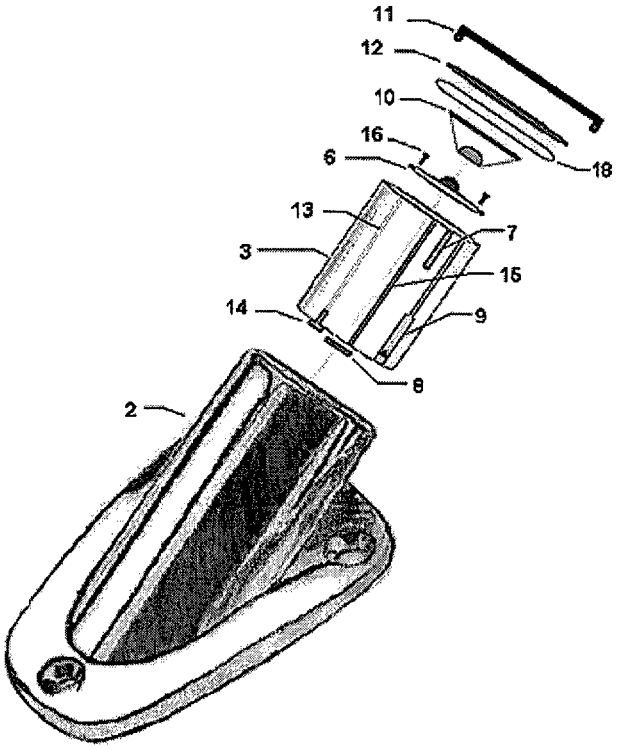
FIG. 1 illustrates on the one hand the overall arrangement of the fixed Inclined Outer Body with cylindrical internal configuration and on the other hand the cylindrically shaped also Solid Thermally Conductive Inner Core (Head), with fitments thereof, which constitute as integral parts of the whole invention.
Figure 2B:
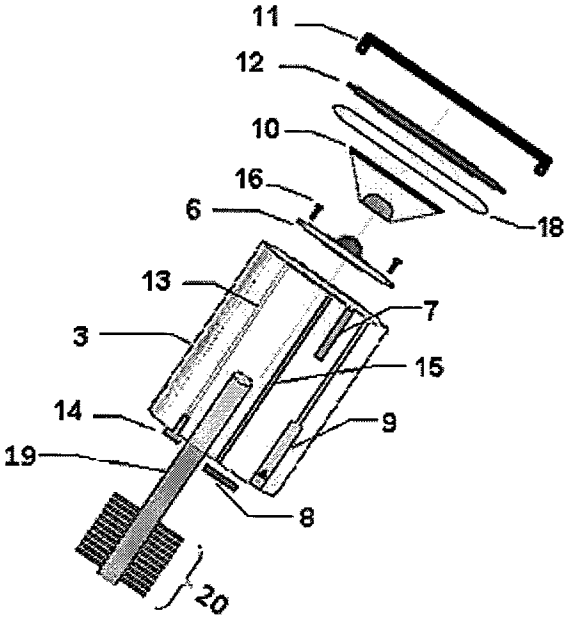
FIGS. 2A and 2B illustrate the Auxiliary Heatsink, which is mounted on the cylindrically shaped Solid Thermally Conductive Inner Core (Head) so that it also facilitates alternatively in cooling.
Figure 2A:
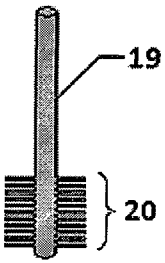
Figure 3:
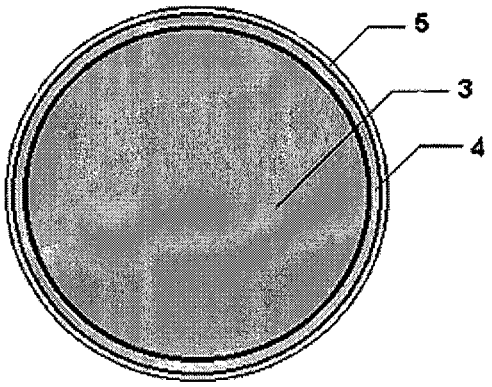
FIG. 3 illustrates the Peripheral Metal Coating with embedded Scaled Thermal Conductivity λ Layers of symmetric or non symmetric metal coating thickness of the cylindrically shaped Solid Thermally Conductive Inner Core (Head), for example one made of copper and one of admixing a mixture with high concentration in Silver.
Figure 4:
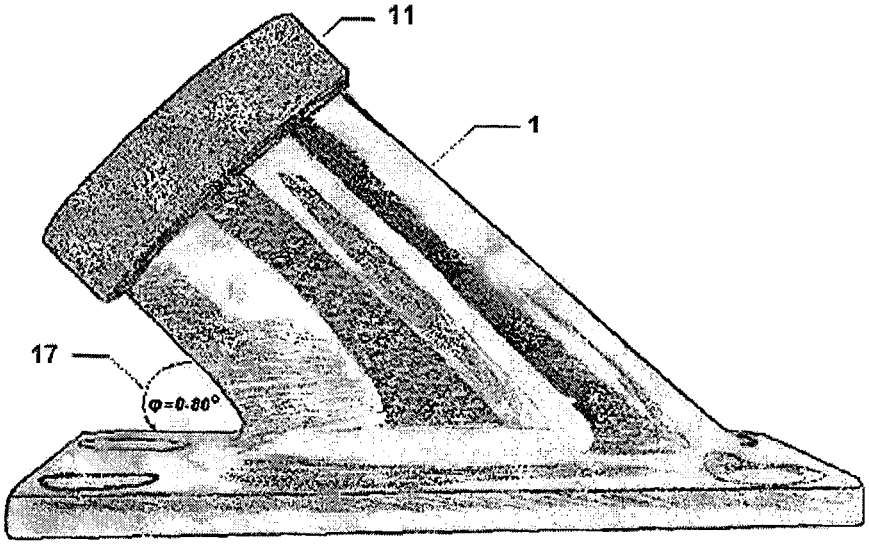
FIG. 4 shows an example of lateral outer aspect of a Fixed Inclined Outer Body with cylindrical internal configuration.

The invention is described in details as follows:

1. The Underwater Light (LED) Fixed Tilt Angle 0°-80° degrees for multiple applications with optional Gyro sensor, according to the present invention has the feature of the structurally fixed Inclined Outer Body (1, 2) with cylindrical internal configuration under tilt angle from 0 up to 80° (17), which is made from corrosion-resistant (in an extremely corrosive environment such as the sea) material, indicatively, alloys of Stainless Steel type AISI 316/L 317/L or Naval Brass etc., or for example Aluminum alloys such as 7075/T6 or 2024/T4 or 6063/T6 or 6061/T6.

2. The cylindrically shaped Solid Thermally Conductive Inner Core (Head) (3), which is made of high Thermal Conductivity λ material, for example Copper, Aluminum, Naval Brass or other thermally conductive alloys depending on the application, bears 1-2 or more Layers of Peripheral Metal Coating (4, 5) with embedded Scaled Thermal Conductivity λ, of symmetric or non symmetric metal coating thickness, made of other metals with higher thermal conductivity λ coefficient, as for example copper (4) and for example, a mixture of high silver concentration (5). The specific practice of Peripheral metal coating and of course the creation of a threaded application of screw type by increasing the contact area between the inner walls of the Inclined Outer Body (1, 2) and the Solid Thermally Conductive Inner Core (Head) (3), with materials of higher thermal conductivity λ coefficient in embedded scaled arrangement and similar thickness, aims in contributing to a faster heat dissipation, which is emitted through the substrate of the light emitting diode LED (6) towards the inner walls of the Inclined Outer Body (1, 2) with cylindrical internal configuration and of course the creation of a constant thermal stress relieving "ring" draught on the outer body's walls thereof. Consequently, the center of the cylindrically shaped Solid Thermally Conductive Inner Core (Head) (3), to where the light emitting diode LED (6) is mounted, is maintained "cooler" and hence it can operate under less thermal stress.

3. The light emitting diode LED (6), which is attached on the front surface of the cylindrically shaped Solid Thermally Conductive Inner Core (Head) (3), consists for example of one or more arrays of light emitting diodes LED of visible or non visible wavelength A' and color temperature T.

4. The thermostat (7) temporarily intervenes for protecting the operation of the unit if the temperature exceeds the predetermined by the construction limit.

5. The optional Gyro Sensor (8) activates the emission of distress signal flashes (SOS) under the each time international codification system for floating means, as long as it is about a choice of this application on floating means (e.g. yacht etc).

6. The Nitrogen (N2) Charging Port (9) ensures the maintenance thereof inside the sealed front chamber, thereby avoiding the creation of corrosion and vapor inside the Lighting Fixture (1, 2).

7. The Auxiliary Heatsink (19, 20) relates to the supplementary cooling function of the cylindrically shaped Solid Thermally Conductive Inner Core (Head).

8. The Rubber Gasket (18) ensures proofing tightness of the device and prevents water penetration.

9. The Beam Reflector (10) relates to the optional arrangement of the visual part for beam convergence or dispersion with structurally predetermined angle.

10. The Front Mounting Ring (11) is the part that gives mechanical strength and clamping strength to the existing sealing units.

11. The External Lens or Diffuser (12) is selected depending on the use of the application, being a Plano-Convex or Flat Crystal.

12. The Pressure Relief Port (13) as well as the Sealing Bolt (14) relate to the joint ensuring of both the tightness of the anterior part and the intake-conservation of nitrogen (N2) gas.

13. The cables for supply of power to the Light Emitting Diode LED (6) pass through the watertight Cabling Channel (15).

14. The mounting bolts (16) support the Light Emitting Diode LED (6) on the surface of the Solid Thermally Conductive Cylindrically Shaped Inner Core (Head) (3).

The invention claimed is:

1. An Underwater Light (LED) of Fixed Tilt Angle 0°-80° degrees for multiple applications with Gyro Sensor, which comprises: a fixed Inclined Outer Body with cylindrical internal configuration, a cylindrically shaped Solid Thermally Conductive Inner Core (Head), a plurality of Peripheral Metal Coating Layers, a Light Emitting Diode LED, a Thermostat, a Gyro Sensor, a Nitrogen (N2) Charging Port, a Beam Reflector, and an Auxiliary Heatsink and is characterized by: the cylindrically shaped Solid Thermally Conductive Inner Core (Head) with 1-2 or more Peripheral Metal Coating Layers with embedded Scaled Thermal Conductivity lambda of symmetric or non symmetric metal coating thickness, by the shape of the metal Inclined Outer Body with cylindrical internal configuration under tilt angle 0°-80° degrees, without moving parts, and finally by the built-in Gyro Sensor, which in overturning of a floating means activates the emission of intermittent flashing distress signal, according to the international Morse Code.

2. The Underwater Light (LED) of Fixed Tilt Angle 0°-80° degrees for multiple applications with Gyro Sensor according to claim 1, the cylindrically shaped Solid Thermally Conductive Inner Core (Head) is made of high Thermal Conductivity material lambda, for example Copper, Aluminum, Naval Brass or other thermally conductive alloys.

3. The Underwater Light (LED) of Fixed Tilt Angle 0°-80° degrees for multiple applications with Gyro Sensor according to claim 1, the cylindrically shaped Solid Thermally Conductive Inner Core (Head) bears 1-2 or more Layers of Peripheral Metal Coating with embedded Scaled Thermal Conductivity lambda, of symmetric or non symmetric metal coating thickness (e.g. copper, for example a mixture of high silver concentration, with the one having the biggest coefficient holding the closest position towards the walls of the fixed Inclined Outer Body with cylindrical internal configuration.

4. The Underwater Light (LED) of Fixed Tilt Angle 0°-80° degrees for multiple applications with Gyro Sensor according to claim 1, the Peripheral Metal Coating Layers may have, as the case may be, threaded development in order to increase the contact heat relief surface with the inner walls of the Inclined Outer Body with cylindrical internal configuration and therefore create continuous heat draught towards this direction.

5. The Underwater Light (LED) of Fixed Tilt Angle 0°-80° degrees for multiple applications with Gyro Sensor according to claim 1 bearing the Gyro Sensor, which, in case of floating means overturning or tip over, activates the emission of intermittent flashing distress signal, according to the international Morse Code, so that it can be recognizable from far away.

6. The Underwater Light (LED) of Fixed Tilt Angle 0°-80° degrees for multiple applications with Gyro sensor according to claim 1 bears preinstalled Thermostat, in order to ensure overheating protection of the Light Emitting Diode LED.

7. The Underwater Light (LED) of Fixed Tilt Angle 0°-80° degrees for multiple applications with Gyro Sensor according to claim 1 bears Nitrogen (INI2) Charging Port in order to ensure inner protection to the body and of course to prevent the phenomenon of both creation of internal corrosion and of steams operating at low temperatures.

8. The Underwater Light (LED) of Fixed Tilt Angle 0°-80° degrees for multiple applications with Gyro Sensor according to claim 1 bearing the Auxiliary Heatsink which contributes to heat dissipation.

* * * * *